US006166484A

United States Patent [19]

Okuyama et al.

[11] Patent Number: 6,166,484

[45] Date of Patent: Dec. 26, 2000

[54] DEFLECTION YOKE, CATHODE-RAY TUBE DEVICE USING THE SAME AND DISPLAY DEVICE

[75] Inventors: Nobutaka Okuyama, Yokohama; Kouji Fukuyama, Mobara; Soichi Sakurai, Yokohama; Hiroshi Yoshioka, Mobara; Masao Obara, Yokohama; Misao Ikeda, Mobara; Takeshi Chiba, Yokohama, all of Japan

[73] Assignees: Hitachi, Ltd., Tokyo; Hitachi Media Electronics Co., Ltd., Mizusawa, both of Japan

[21] Appl. No.: 09/124,757

[22] Filed: Jul. 29, 1998

[30] Foreign Application Priority Data

Jul. 29, 1997 [JP] Japan ..... 9-203063
Jul. 29, 1997 [JP] Japan ..... 9-203064

[51] Int. Cl.[7] ..... H01J 29/76

[52] U.S. Cl. ..... 313/440; 313/442; 313/431; 335/213

[58] Field of Search ..... 313/440, 426, 313/431, 413, 442; 335/213, 210

[56] References Cited

U.S. PATENT DOCUMENTS

| | | | |
|---|---|---|---|
| 4,376,924 | 3/1983 | Gross et al. | 335/210 |
| 5,455,483 | 10/1995 | Azzi et al. | 313/440 |
| 5,548,190 | 8/1996 | Okuyama et al. | 315/368.26 |
| 5,859,495 | 1/1999 | Honda et al. | 313/440 |
| 5,880,660 | 3/1999 | Iwasaki et al. | 335/213 |

FOREIGN PATENT DOCUMENTS

| | | |
|---|---|---|
| 3-141540 | 6/1991 | Japan . |
| 3-165427 | 7/1991 | Japan . |
| 94-3047 | 9/1985 | Rep. of Korea . |

*Primary Examiner*—Michael H. Day
*Attorney, Agent, or Firm*—Evenson, McKeown, Edwards & Lenahan, P.L.L.C.

[57] ABSTRACT

A deflection yoke for a CRT including a horizontal deflection coil having an axial length in an axial direction of the CRT in an installed position that is not less than 60 mm and not more than 80 mm, a vertical deflection coil having an axial length in an axial direction that ranges from 45 mm to 65 mm, and a core having an axial length in the axial direction that ranges from 25 mm to 45 mm. The subject deflection yoke prevents deterioration in horizontal and vertical deflection sensitivity in CRTs having a neck diameter that is greater than 22 mm and less than 26 mm with a deflection angle that ranges from 95 to 110 degrees. In an alternate embodiment a deflection yoke for a CRT including a horizontal deflection coil, a vertical deflection coil disposed outside of the horizontal deflection coil, and a core disposed outside of the vertical deflection coil wherein in an installed position of the yoke, an inner surface of the deflection yoke is circumscribed around a circle having a diameter of 56.5 mm and the horizontal deflection coil has a length thereof extending from the tube axial position to an opening end of the horizontal deflection coil ranges from 20.5 mm to 24.5 mm and a length thereof extending from the tube axial position to a neck end of the horizontal deflection coil ranges from 46 mm to 50 mm. The subject deflection yoke reduces neck shadow in color CRTs having a 95 to 105 degree deflection with a 400 to 420 mm diagonal and a neck having an outside diameter form 23.6 mm to 25.0 mm at a portion where the deflection yoke is attached.

17 Claims, 11 Drawing Sheets

DEFLECTION YOKE, CATHODE-RAY TUBE DEVICE USING THE SAME AND DISPLAY DEVICE

BACKGROUND OF THE INVENTION

The present invention relates to a deflection yoke suitable for use in a cathode ray tube, a cathode-ray tube device using the deflection yoke, and a display device which uses such a deflection yoke. In particular, the invention relates to a high-sensitivity deflection yoke which is adaptable for use in a color cathode ray tube with a wide deflection angle and short overall length, as well as to a display device using such a deflection yoke.

"National Technical Report", Vol. 42, No. 3, pp. 93–100 discloses conventional examples of both a color cathode ray tube used for a display device, in which a diagonal dimension of a fluorescent screen is about 410 mm, with a deflection angle of about 100° (hereinafter called "41 cm-100°"), and a deflection yoke employed in the color cathode ray tube. The outside diameter of the neck of the conventional color cathode ray tube described in this reference is 29.1 mm (hereinafter called "29.1 mm neck"). The deflection yoke used in this type of color cathode ray tube is commercially available.

The axial length of the color cathode ray tube illustrated in the National Technical Report is 348 mm, and the tube-axial length of the horizontal deflection coil of the deflection yoke used in the color cathode ray tube is long—approximately 93 mm. When the axial length is shortened further, this deflection yoke cannot be used, and new development is needed.

The minimum inside diameter of the horizontal deflection coil in the conventional deflection yoke is large—on the order of 31.5 mm. In the case of a tube-axial position in which the inner surface of a circular deflection yoke has a diameter of 56.5 mm, the length of the portion of the horizontal deflection coil which extends to the opening end of the deflection yoke is about 37 mm, and the length of the portion which extends to the end on the neck side, is about 56 mm. Thus, its overall length reaches 93 mm. Further, such a deflection yoke has the additional drawback that because a fringe is formed on the opening side of the horizontal deflection coil, in a circle having a diameter of about 165 mm, the inductance of the horizontal deflection coil increases due to a magnetic field that does not contribute to the deflection of the opening-side fringe. As a result, horizontal deflecting sensitivity is deteriorated.

It is important that the deflection yoke reduce the undesired emissive magnetic field generated around the cathode-ray tube device, at least to a given value. For example, a guideline called "TCO" addresses the undesired emissive magnetic field in a low frequency band of 400 kHz or less in particular. This guideline stipulates that extremely low frequency magnetic fields (ELMF) of 5 Hz to 2 kHz that leaks principally from a vertical deflection coil of the deflection yoke, should be kept at or below 200 nT (Tesla) at a measurement point 50 cm around the display device and 30 cm from a tube surface of the cathode-ray tube device. Also very low frequency magnetic fields (VLMF) of 2 kHz to 400 kHz that principally leak from the horizontal deflection coil of the deflection yoke, should be maintained at 25 nT or less.

Since the deflection yoke is regarded as the principal generation source of ELMF and VLMF, it has frequently been proposed to provide means for allowing the deflection yoke to generate a reversed polarity magnetic field, thereby reducing the undesired emissive magnetic field to the normalized value or less in order to cancel the undesired emissive magnetic field.

An undesired emissive magnetic field reduction device is disclosed, for example, in Japanese Patent Application Laid-Open No. Hei 3-289029. In this arrangement, respective canceling coils for reducing undesired emissive magnetic fields are electrically connected to a horizontal deflection coil and a vertical deflection coil, which are used to generate additional magnetic fields that cancel the undesired emissive magnetic fields generated from the horizontal deflection coil and the vertical deflection coil. In this manner, the undesired emissive magnetic fields are reduced.

In the above prior art, however, connection of the canceling coils to both the coils causes a reduction or desensitization in horizontal deflecting sensitivity and vertical deflecting sensitivity. Further, the connection of the canceling coils as described above increases the shape of the deflection yoke and increases the cost of the deflection yoke.

SUMMARY OF THE INVENTION

With the foregoing in view, it is an object of the present invention to provide a deflection yoke which is minimized in size and cost, as well as a cathode-ray tube device and a display device using the deflection yoke.

Another object of the present invention is to provide a deflection yoke suitable for use in a 95°-to-110° deflection type color cathode ray tube, which solves the above problems, provides satisfactory horizontal deflecting sensitivity and shortens the axial length of the color cathode ray tube, as well as a cathode-ray tube device and a display device using the deflection yoke.

A further object of the present invention is to provide a deflection yoke suitable for use in a color cathode ray tube wherein a neck diameter of a deflection yoke mounting portion ranges from 22 mm to 26 mm, a diagonal dimension of a fluorescent material ranges from 400 mm to 420 mm and a deflection angle ranges from 95° to 110°, as well as a cathode-ray tube device and a display device using the deflection yoke.

A still further object of the present invention is to provide a deflection yoke for a color cathode ray tube, which can prevent deterioration of horizontal deflecting sensitivity and vertical deflecting sensitivity, and also suppresses the generation of undesired emissive magnetic fields with satisfactory efficiency.

These and other objects and advantages are achieved by the deflection yoke according to the present invention, in which a horizontal deflection coil whose dimension in the axial direction of a cathode ray tube to which the deflection yoke is attached, ranges from 60 mm to 80 mm. A vertical deflection coil whose dimension relative to the axial direction ranges from 45 mm to 65 mm; and a core whose dimension relative to the axial direction ranges from 25 mm to 45 mm.

In one embodiment of the invention, the deflection yoke according to the present invention is also constructed so that the distance between an end of the horizontal deflection coil at the opening side thereof ("opening and)" and the opening end of the core is at least 15 mm.

In another embodiment, the deflection yoke according to the present invention is constructed so that the distance between the opening end of the vertical deflection coil and the opening end of the core is at least 5 mm.

Further, in order to achieve the above objects, the present invention provides a deflection yoke which is mounted over an area between a funnel of a cathode ray tube and a neck thereof, the cathode ray tube having a 41 cm fluorescent screen (diagonal dimension range from 400 mm to 420 mm); the funnel adapted to a deflection of 100° (deflections ranging from 95° to 105°); the neck whose outside diameter ranges from 23.6 mm to 25.0 mm; and an electron gun for generating inline-arranged multiple electron beams, and which has a horizontal deflection coil and a vertical deflection coil. The length of the horizontal deflection coil, which extends to an opening end thereof, ranges from not less than 20.5 mm to not more than 24.5 mm, while the length of the horizontal deflection coil, extending up to a neck end thereof, ranges from not less than 46 mm to not more than 50 mm. An inner surface of the axially positioned deflection yoke is circumscribed around a circle having a diameter of 56.5 mm.

Moreover, in the deflection yoke according to the present invention the minimum inside diameter of the horizontal deflection coil ranges from not less than 25 mm to not more than 27 mm. A tube-axial length of the horizontal deflection coil ranges from not less than 66.5 mm to not more than 74.5 mm; and a fringe on the opening side, of the horizontal deflection coil is configured so that it is inscribed in a circle whose diameter ranges from 125 mm to 135 mm.

A color cathode-ray tube device according to the present invention comprises: a color cathode ray tube having a fluorescent screen whose diagonal dimension ranges from 400 mm to 420 mm, a funnel suited to deflections of 95° to 105°, a neck whose outside diameter ranges from not less than 23.6 mm to not more than 25.0 mm, and an electron gun provided within the neck for generating inline-arranged multiple electron beams. A deflection yoke is mounted over a range from the funnel of the cathode ray tube to the neck thereof, and has a horizontal deflection coil and a vertical deflection coil. The position of an opening end of the horizontal deflection coil is placed within a range of between 16.5 mm and 22.5 mm from a tube axial reference position at which the outside diameter of the funnel is 56.5 mm; and the position of a neck end of the horizontal deflection coil is placed within a range of from 48 mm to 54 mm from the same reference.

Therefore, axial length of the color cathode ray tube in a 41 cm-100° color cathode-ray tube device can be achieved in a range of 338 mm to 344 mm.

Other objects, advantages and novel features of the present invention will become apparent from the following detailed description of the invention when considered in conjunction with the accompanying drawings.

DESCRIPTION OF THE PREFERRED EMBODIMENT

Preferred embodiments of a deflection yoke according to the present invention, a cathode ray tube and a display unit or device using the deflection yoke are described hereinafter with reference to the accompanying drawings.

Figure 1:
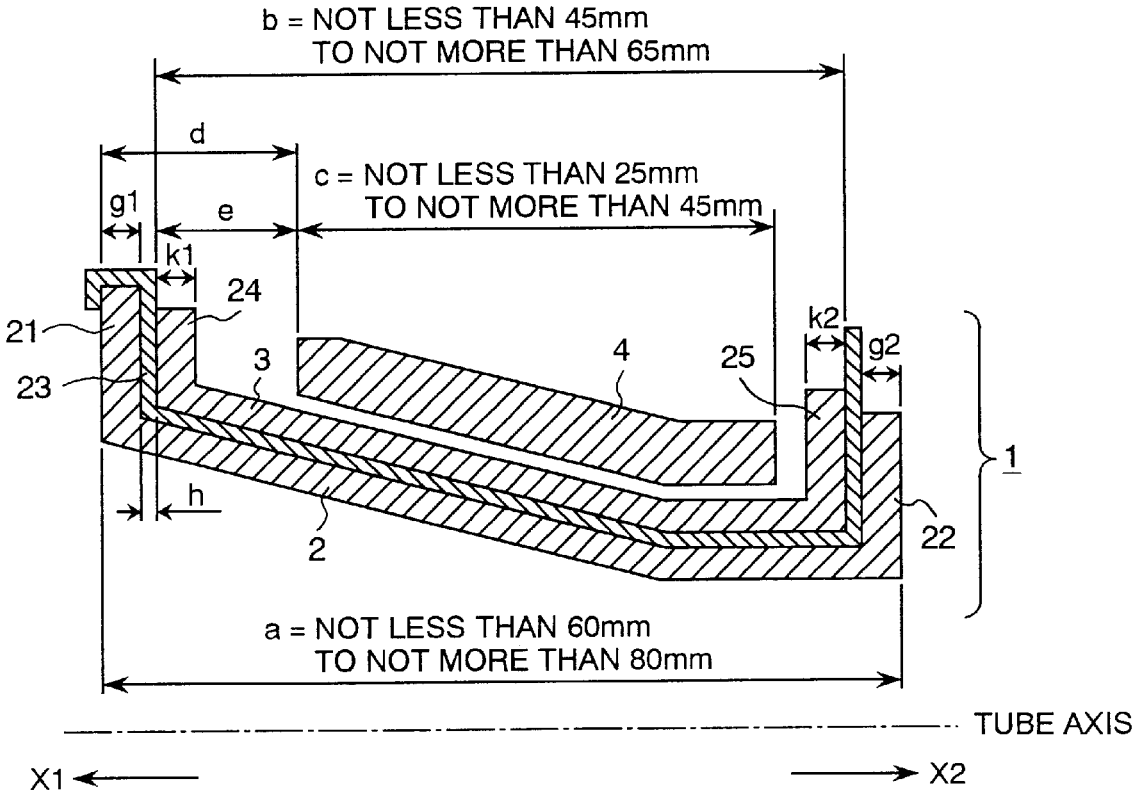
FIG. 1 is a fragmentary cross-sectional view showing an embodiment of a deflection yoke according to the present invention.

FIG. 1 is a fragmentary cross-sectional view showing an embodiment of a deflection yoke according to the present invention. Reference numeral 1 indicates a deflection yoke, while 2 is a horizontal deflection coil, 3 is a vertical deflection coil, and 4 is a core respectively.

The vertical deflection coil 3 is disposed on the inner surface side of the core 4, and the horizontal deflection coil 2 is on the inner surface side of the vertical deflection coil 3, these three components collectively forming the deflection yoke 1. The deflection yoke 1 configured in this way is suitable for use in a cathode ray tube whose neck diameter ranges from 22 mm to 26 mm and whose deflection angle ranges from 95° to 110°.

It has been determined experimentally that the dimension a of the horizontal deflection coil 2 extending in the axial direction of the cathode ray tube provided with the present deflection yoke, is preferably within a range of from 60 to 80 mm; the dimension b of the vertical deflection coil 3 is preferably between 45 and 65 mm; and dimension c of the core 4 should be from 25 mm to 45 mm, as explained below.

In FIG. 1, d indicates the dimension between an opening end of the horizontal deflection coil 2 and an opening end of the core 4, e indicates the dimension between an opening end of the vertical deflection coil 3 and the opening end of the core 4, X1 indicates the opening direction of the deflection yoke 1, and X2 indicates the direction of the neck side on the deflection yoke 1.

Figure 2:
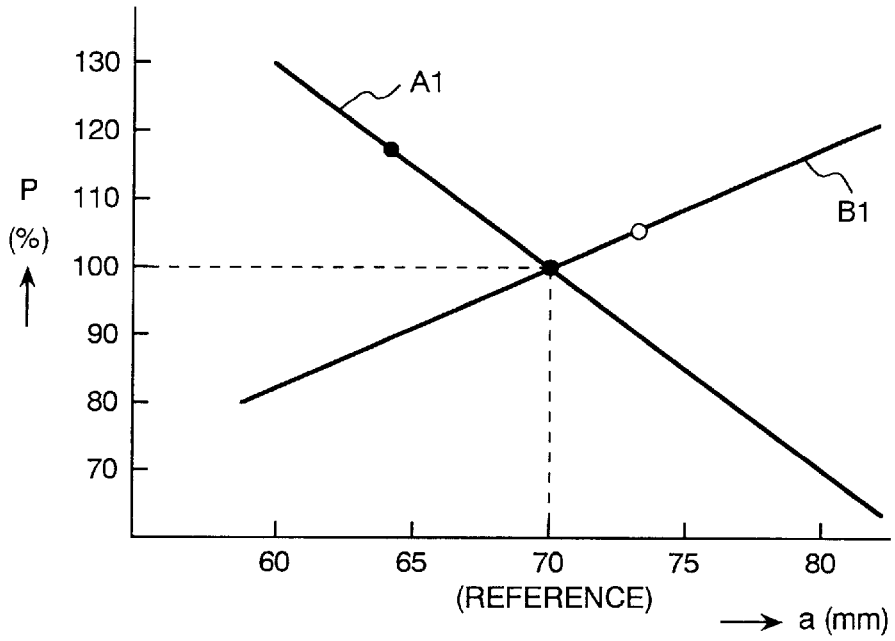
FIG. 2 is a characteristic diagram illustrating a horizontal deflection power rate obtained when the tube axial dimension a of the horizontal deflection coil of FIG. 1 is varied.

FIG. 2 is a characteristic diagram which shows a rate of change in normalized horizontal deflection power when the tube-axial dimension of the horizontal deflection coil is varied. (The horizontal axis indicates the overall dimension a of the horizontal deflection coil 2, and the vertical axis indicates horizontal deflection power rate P.) In FIG. 2, the horizontal deflection power rate P is 100% when the overall dimension a of the horizontal deflection coil 2 is 70 mm.

The characteristic A1 indicates the horizontal deflection power rate or exponent as a function of the length of the deflection yoke 1 on the neck side. (That is, the end of the deflection yoke 1 is extended or shortened in the direction of the neck, with the overall dimension a of the horizontal deflection coil 2 being set to 70 mm as the reference.) The characteristic B1 indicates a horizontal power rate or exponent P obtained when the length of the deflection yoke 1 is changed at the opening side. That is, the end of the deflection yoke 1 is extended or shortened at the opening end, also called "fluorescent screen end", with the overall dimension a of the horizontal deflection coil 2 being set to 70 mm (and a horizontal power rate or exponent P of 100) as the reference as described above.

As is apparent from the characteristic A1 in FIG. 2, the horizontal deflection power rate or exponent P is reduced to less than 100% when the end of the deflection yoke 1 is extended toward the neck (also called "on the electron gun side") so that its overall dimension a is longer than 70 mm. The reduction of the horizontal power rate or exponent P to below 100% means that the power consumed by a horizontal deflection circuit for driving the deflection yoke 1 is lowered. This means that deflecting sensitivity of the deflection yoke 1 is improved. When the deflection yoke 1 is shortened at the neck end to such an extent that the dimension a of the horizontal deflection coil 2 is less than 70 mm, the horizontal deflection power rate or exponent P increases to more than 100%, so that the horizontal deflecting sensitivity is reduced.

The characteristic B1 in FIG. 2, shows that the deflection yoke 1 is shortened in the opening direction so that the overall dimension a of the horizontal deflection coil 2 is shorter than 70 mm, the horizontal deflection power rate or exponent P is reduced to below 100%, so that the horizontal deflection sensitivity is improved. On the other hand, when the dimension a reaches more than 70 mm, the horizontal deflection power rate or exponent P becomes more than 100%, and the horizontal deflection sensitivity is lowered.

Figure 3:
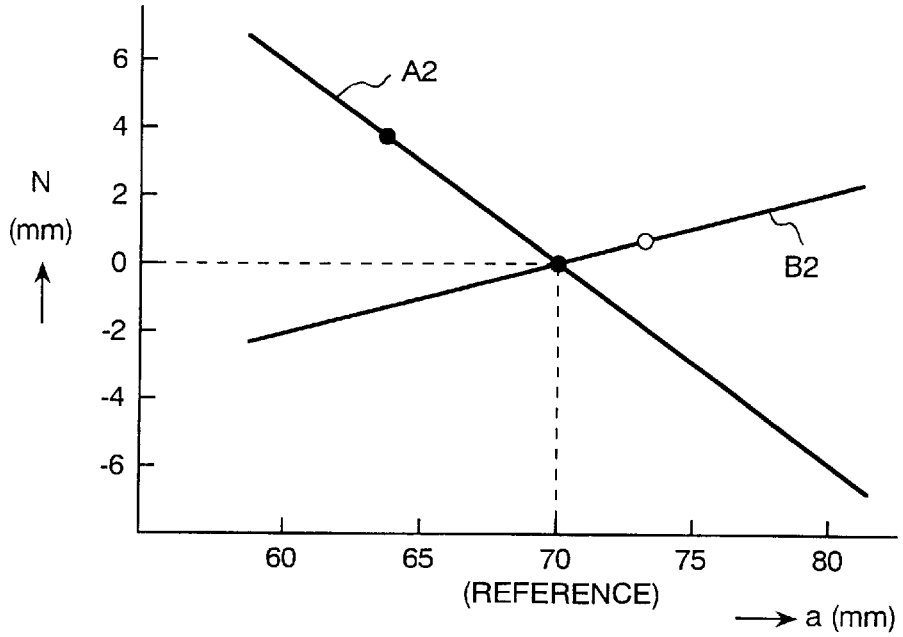
FIG. 3 is a characteristic diagram illustrating the amount of change in BSN in response to variation of the tube-axial length of the horizontal deflection coil of FIG. 1.

A change in neck shadow tolerance BSN of an electron beam in response to variation of the dimension a of the horizontal deflection coil 2 in the tube-axial direction is shown in FIG. 3. The neck shadow tolerance BSN is the distance to which the deflection yoke 1 can be drawn away from the fluorescent screen of the cathode ray tube—that is, away from direct contact with a glass envelope of the cathode ray tube—until some of the electron beam is blocked by the glass envelope, generating a "neck shadow" so that any of the four corners of the fluorescent screen is not illuminated.

FIG. 3 shows change of the BSN in response to variation of the tube-axial length of the horizontal deflection coil 2 in FIG. 1. The horizontal axis indicates dimension a of the horizontal deflection coil 2, and the vertical axis indicates the change N in BSN. The characteristic A2 indicates the change N of BSN in response to changes in the length of the deflection yoke 1 on the neck side, with the overall dimension a of the horizontal deflection coil 2 being set to 70 mm as the reference. The characteristic B2, on the other hand, indicates the change N in BSN in response to variation of the length of the deflection yoke 1 in the opening direction, with the overall dimension a of the horizontal deflection coil 2 being set to 70 mm (and a corresponding value of N=O mm) as the reference as described above.

As is apparent from the characteristic A2, BSN becomes shorter (is thus deteriorated) when the neck side of the deflection yoke 1 is lengthened so that the overall dimension a of the horizontal deflection coil 2 exceeds 70 mm, whereas BSN increases (and is thereby improved) when the dimension a is shorter than 70 mm.

As also shown by the characteristic B2, BSN becomes shorter (is deteriorated) when the deflection yoke 1 is shortened in the opening direction so that the overall dimension a of the horizontal deflection coil 2 is less than 70 mm, and increases (and hence improves) when the dimension a is longer than 70 mm.

It can be seen from the characteristic diagrams shown in FIGS. 2 and 3 that the horizontal deflection power rate or exponent P has an inverse relation to BSN. If the deflection yoke 1 is extended only in the neck direction, to improve the horizontal deflection power rate or exponent P as shown in FIG. 2, for example, BSN becomes short as shown in FIG. 3. Hence, both the objectives are not served. On the other hand, if the deflection yoke 1 is lengthened in the opening direction to improve the horizontal deflection power rate or exponent P (FIG. 2) in the same manner as described above, BSN becomes short as shown in FIG. 3. Hence, once again both ends are not served. As a result, when the neck end of the deflection yoke 1 is lengthened, the opening side may also be lengthened simultaneously with its increase to satisfy both the characteristics. Similarly, when the neck end of the deflection yoke 1 is shortened, it is necessary to shorten the opening side at the same time.

However, when the dimension a of the horizontal deflection coil 2 is increased excessively in the neck direction, the electron gun is affected adversely, so that image focus is degraded, as explained below with reference to FIG. 4.

Figure 4:
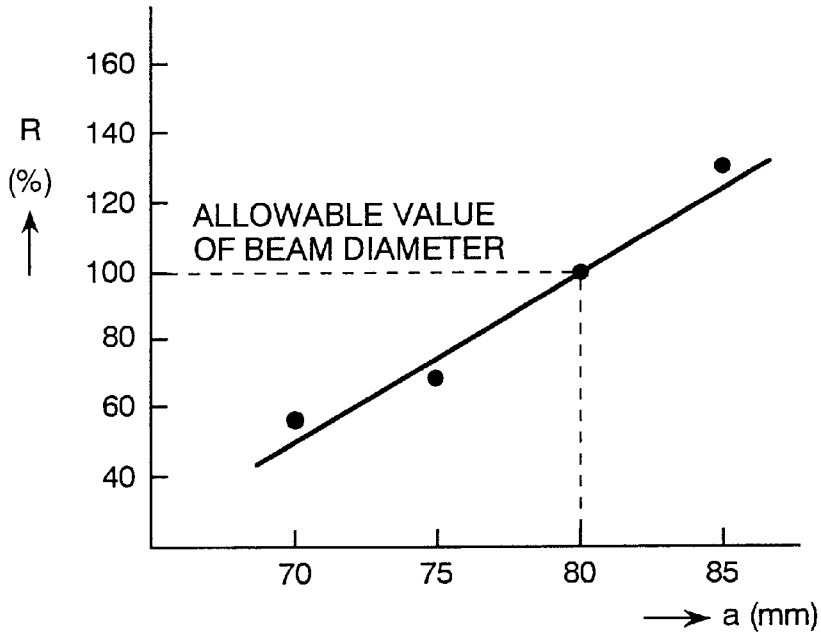
FIG. 4 is a characteristic diagram depicting the rate of change in the diameter of an electron beam in response to variation of the dimension of the horizontal deflection coil of FIG. 1.

FIG. 4 is a characteristic diagram showing the rate of change in the diameter of an electron beam in response to variation of the dimension of the horizontal deflection coil. The horizontal axis represents dimension a of the horizontal deflection coil, and the vertical axis indicates the percentage change R in beam diameter. The maximum beam diameter, at which the degradation in focus offers no problem, is represented as 100% in FIG. 4, which thus represents an upper acceptable limit. Accordingly, as is apparent from FIG. 4, the dimension a of the horizontal deflection coil 2, which is allowable for the degradation in focus, is 80 mm or less.

When both the opening end and neck end of the deflection yoke 1 are shortened to reduce the shape of the horizontal deflection coil 2, a problem arises in that the temperature rises, as explained below with reference to FIG. 5.

Figure 5:
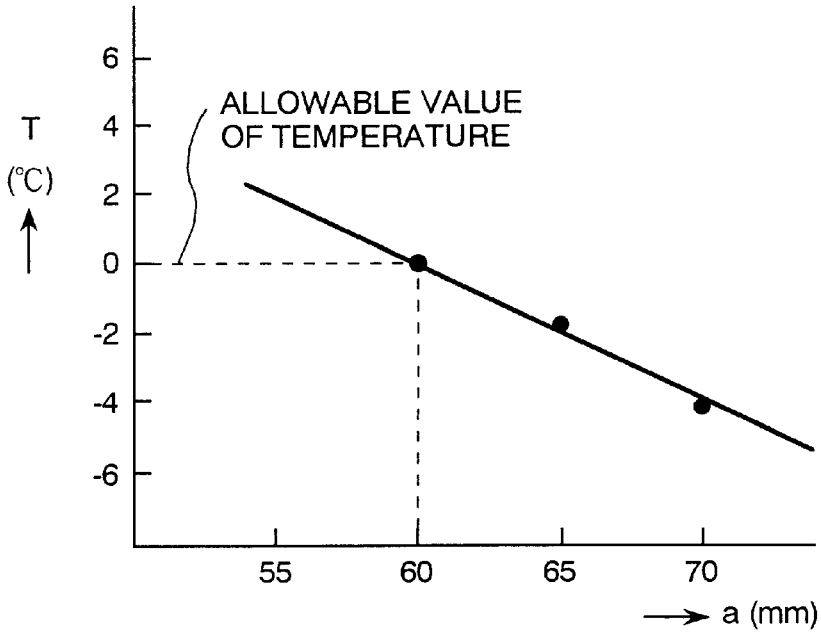
FIG. 5 is a characteristic diagram showing a rise in the temperature of the deflection yoke as a function of the dimension of the horizontal deflection coil FIG. 1.

FIG. 5 is a characteristic diagram showing a rise in the temperature of the deflection yoke in response to variation of the dimension a of the horizontal deflection coil of FIG. 1. The horizontal axis represents the dimension a of the horizontal deflection coil 2, and the vertical axis indicates temperature T. The maximum allowable temperature of the deflection yoke 1 is represented as the reference (i.e., 0) in the drawing; it is necessary to keep the deflection yoke 1 at a temperature lower than the reference. As is apparent from the characteristic diagram, the dimension a of the horizontal deflection coil 2 which satisfies the allowable value of the rise in temperature, is 60 mm and above.

It is thus necessary to set the dimension a of the horizontal deflection coil 2 to not less than 60 mm and not more than 80 mm, judging from the results shown in FIGS. 4 and 5.

The tube-axial dimension b of the vertical deflection coil 3 shown in FIG. 1 will next be described. This dimension can be determined by subtracting the thickness g1 of a fringe 21 (also called "span portion") on the opening of the horizontal deflection coil 2, the thickness g2 of fringe 22 at the neck, and thickness h of a separator 23 (which insulates between the horizontal deflection coil 2 and the vertical deflection coil 3), from the tube-axial dimension a of the horizontal deflection coil 2. Each of the thicknesses g1 and g2 of the fringes 21, 22 of the horizontal deflection coil 2 (see FIG. 1) ranges from about 4 mm to 7 mm, and is about 6.3 mm as an average value. The thickness h of the separator 23 is about 1 mm at each of the opening and neck ends, and about 1.2 mm as an average value. Thus, the tube-axial dimension b of the vertical deflection coil 3 can be obtained by subtracting about 15 mm from the tube-axial dimension a of the horizontal deflection coil 2. Accordingly, the dimension of the vertical deflection coil reaches values between 45 mm and 65 mm.

Similarly, the tube-axial dimension c of the core 4 (shown in FIG. 1) can be determined by subtracting the total of the thicknesses k1 and k2 of the fringes 24 and 25 at the opening and neck ends of the vertical deflection coil 3 and spaces between the opening and neck ends of the vertical deflection coil 3 and the core 4, from the tube-axial dimension b of the vertical deflection coil 3. The fringe thicknesses k1 and k2 on the opening and neck ends of the vertical deflection coil 3 are each about 4 to 7 mm and about 6.3 mm as an average value, while the dimension of a space between the neck end fringe 24 of the vertical deflection coil 3 and the core 4 is about 1 mm, and the space between the vertical deflection coil 3 and core 4 (taking into consideration measures for undesired emissions) is about 6.5 mm. Therefore, it can be seen that the tube-axial dimension c of the core 4 is about 20 mm shorter than the tube-axial dimension b of the vertical deflection coil 3. Thus, the dimension b reaches values ranging from not less than 25 mm to not more than 45 mm.

In the deflection yoke 1 according to the present invention as has been described above, the dimension a of the horizontal deflection coil 2 is set to a range of 60 to 80 mm, the dimension b of the vertical deflection coil 3 ranges from 45 mm to 65 mm, while the dimension c of the core 4 is between 25 and 45 mm. As a result, the present deflection yoke 1 can be suitably applied to a cathode ray tube having a neck with a diameter of from 22 mm to 26 mm, and a deflection angle that is between 95° and 110°.

A description will next be made of a deflection yoke suitable for use in a cathode ray tube having a neck diameter of a deflection yoke mounting portion which ranges from 23.6 mm to 25 mm, a deflection angle from 95° to 105°, and a diagonal dimension of a fluorescent screen of from 400 mm to 420 mm.

Figure 6:
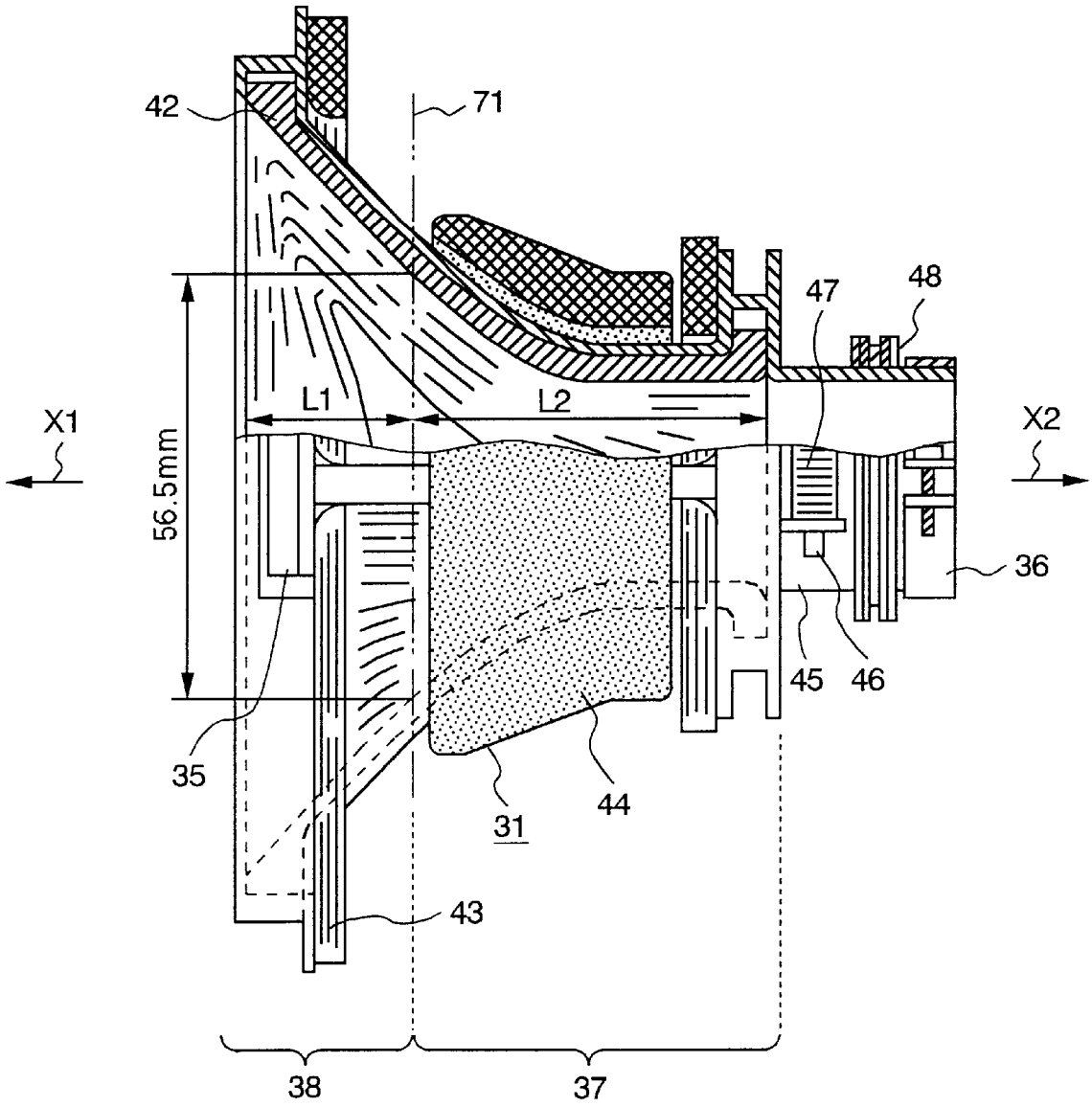
FIG. 6 is a transverse cross-sectional view illustrating another embodiment of a deflection yoke according to the present invention.

FIG. 6 is a transverse cross-sectional view showing another embodiment of a deflection yoke according to the present invention, which includes a deflection yoke 31, a bar magnet 35, a clamping band 36, a neck side 37 of the deflection yoke 31, an opening side 38 of the deflection yoke 31, a horizontal deflection coil 42, a main vertical deflection coil 43, a main core 44, a separator 45, a subcore 46, an auxiliary vertical deflection coil 47, a ring-shaped magnet 48, and a reference line 71 of the deflection yoke 31. It should be noted that the configuration of the deflection yoke shown in FIG. 6 can be applied even to the deflection yoke shown in FIG. 1.

In the drawing, the deflection yoke 31 has the horizontal deflection coil 42, the main vertical deflection coil 43, the main core 44, the separator 45, the subcore 46, the auxiliary vertical deflection coil 47, the ring-shaped magnet 48, the bar magnet 35 and the clamping band 36.

Figure 7:
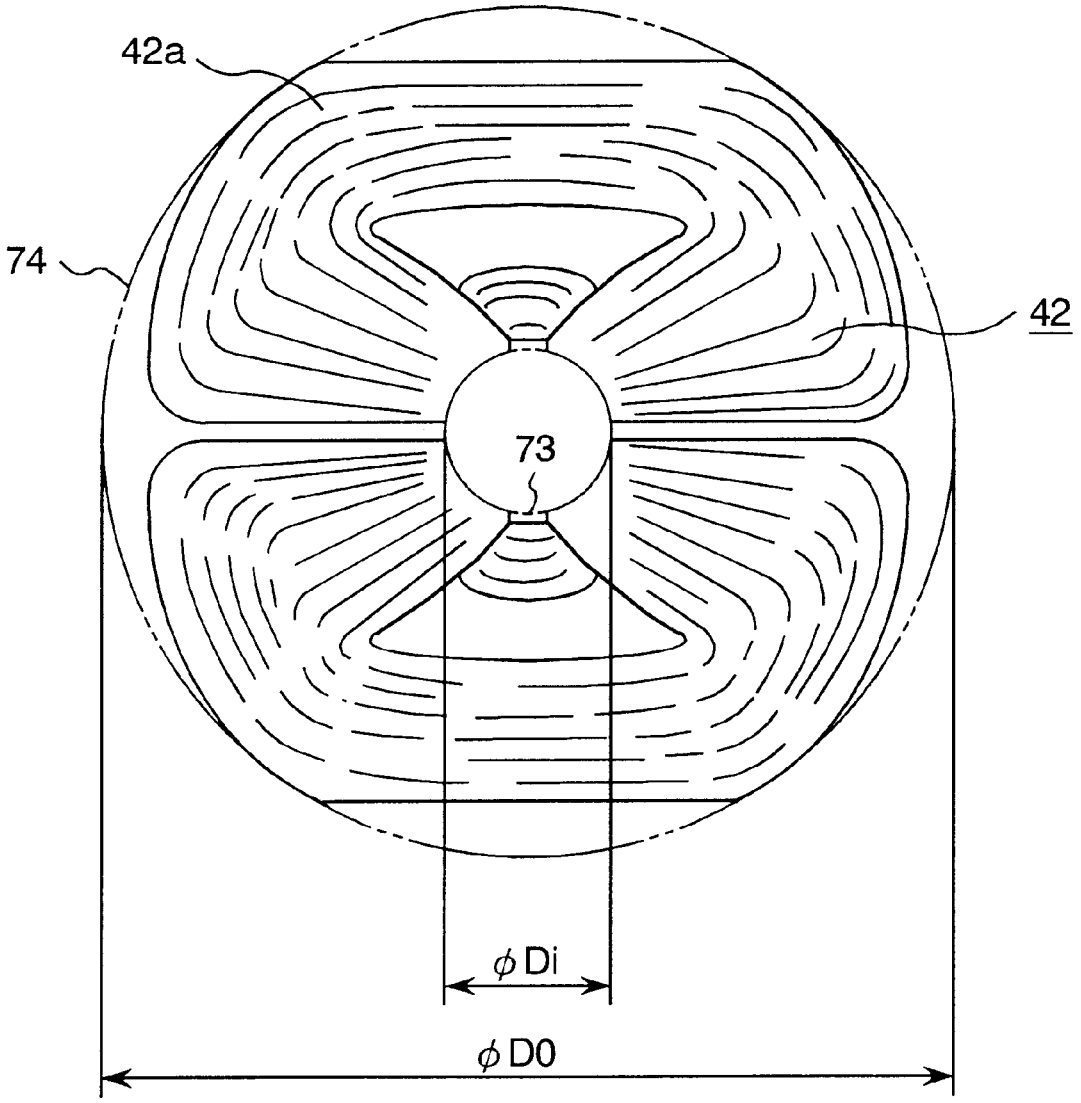
FIG. 7 is a front view of the deflection yoke shown in FIG. 1.

The horizontal deflection coil 42 surrounds a circle 73 and is surrounded by a circle 74 as shown in FIG. 7.

Figure 8A:
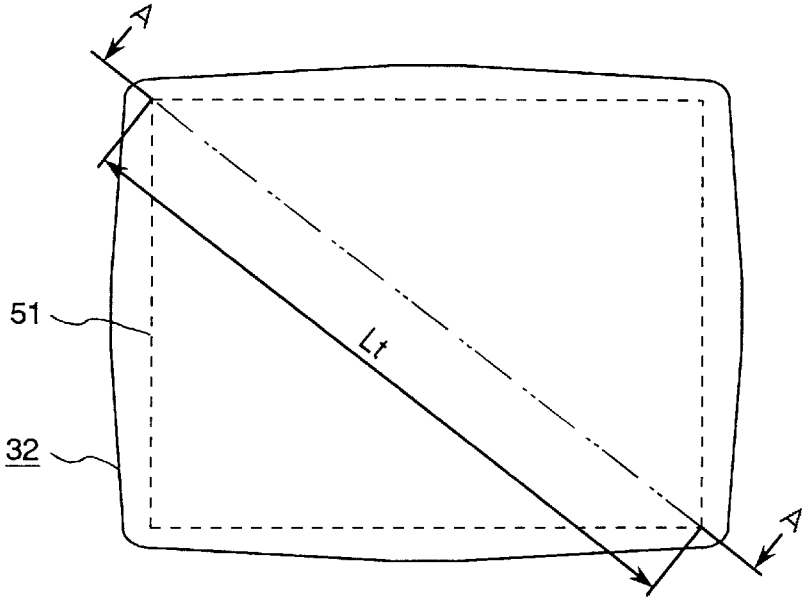
FIG. 8A is a front view showing a fluorescent screen of a color cathode ray tube.
Figure 8B:
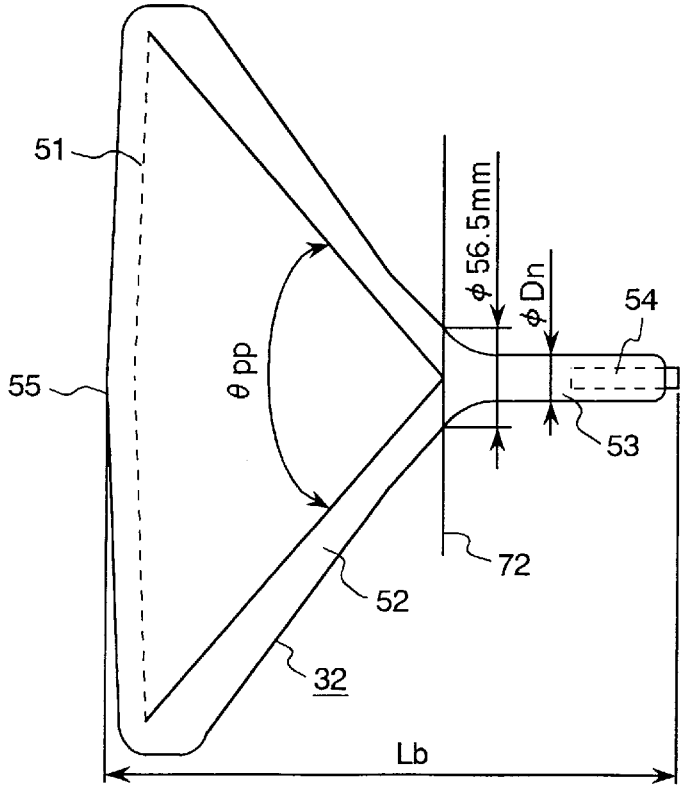
FIG. 8B is a diagram of the color cathode ray tube as seen in the direction indicated by arrows A, A in FIG. 8A.

FIG. 7 is a front view of the deflection yoke shown in FIG. 1. FIG. 8A is a front view showing a fluorescent screen of a color cathode ray tube, and FIG. 8B shows the color cathode ray tube, as seen in the direction indicated by arrows A, A in FIG. 8A. In the drawing, reference numeral 32 indicates a color cathode ray tube, while 51 is a fluorescent screen, 52 is a funnel, 53 a neck, 54 an electron gun for generating inline-arranged multiple electron beams, 55 a panel, and 72 a reference line of the color cathode ray tube 32 respectively.

In FIG. 8B, the color cathode ray tube 32 has the fluorescent screen 51, the funnel 52, the neck 53, the electron gun 54 and the panel 55. Lb indicates the length of the color cathode ray tube 32. Although not shown in the drawing, a shadow mask, an inner shield, etc. are provided within the color cathode ray tube 32.

Figure 9:
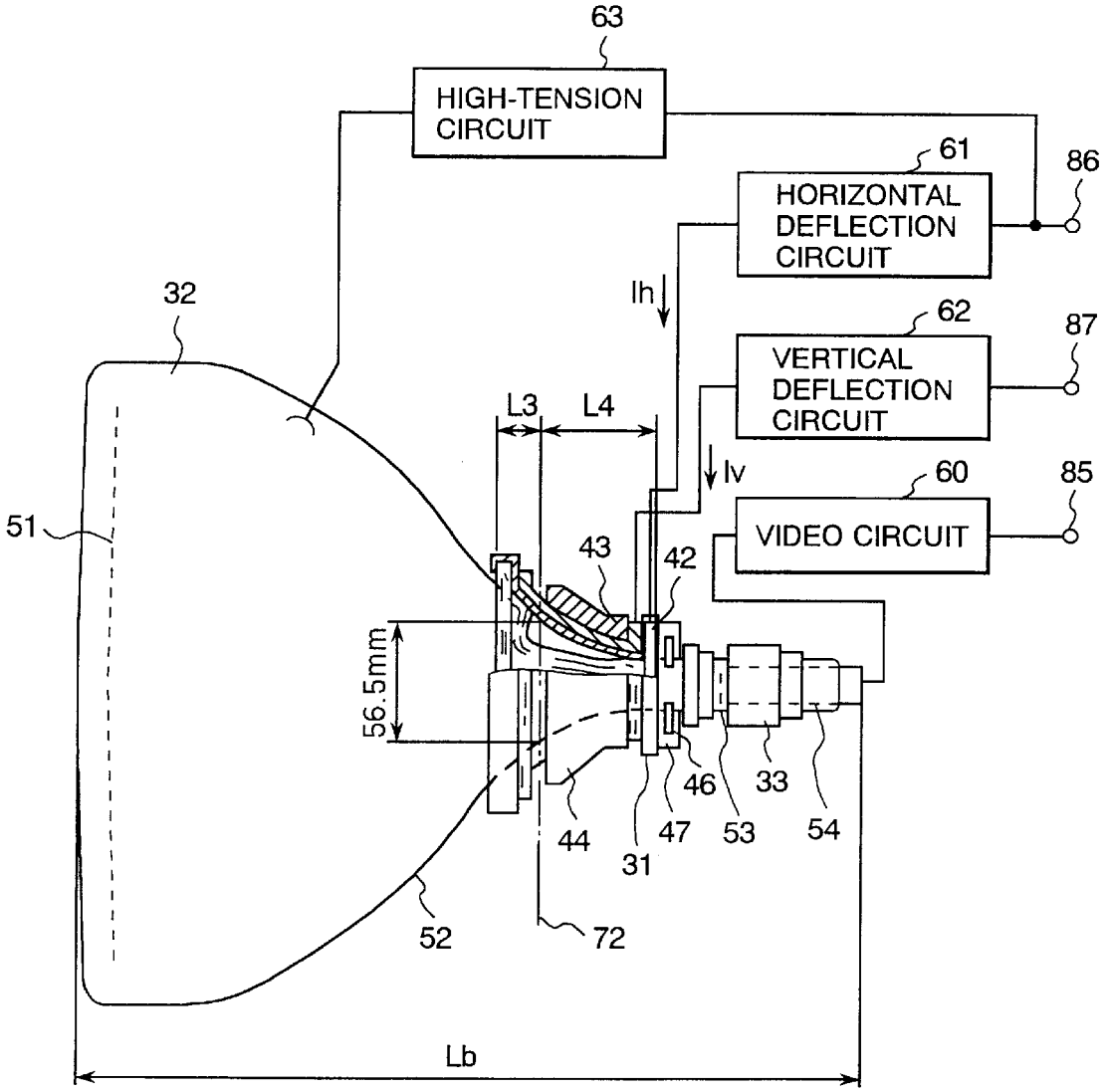
FIG. 9 is a block diagram illustrating one embodiment of a display device having a color cathode ray tube provided with a deflection yoke according to the present invention, and its peripheral circuits.

FIG. 9 is a block diagram illustrating one embodiment of a display device comprised of a color cathode ray tube provided with a deflection yoke according to the present invention, and its peripheral circuits. Reference numeral 60 indicates a video circuit, while 61 is a horizontal deflection circuit, 62 is a vertical deflection circuit, 63 a high-tension circuit, 85 a terminal for inputting a video signal, 86 a terminal for inputting a horizontal synchronizing signal, and 87 a terminal for inputting a vertical synchronizing signal, respectively. Parts corresponding to those shown in FIGS. 6 to 8 are identified by the same reference numerals.

In FIG. 9, a static convergence magnet 33 is attached to the color cathode ray tube 32. The video circuit 60, the horizontal deflection circuit 61, the vertical deflection circuit 62, the high-tension circuit 63, etc. constitute the associated peripheral circuits.

As shown in FIGS. 8A and 8B, the color cathode ray tube 32 has a front panel 55 which includes a fluorescent screen 51 having a diagonal dimension Lt (taken along line A—A) which is approximately 410 mm (that is, falls within the 400- to 420-mm range). The funnel 52 is disposed at an intermediate portion of the cathode ray tube and is fit for the deflection of about 100°; the neck 53 is at a rear portion thereof and has an outside diameter ϕDn of about 24.3 mm. The electron gun 54 for generating the inline-arranged multiple electron beams is provided at the rear end of the neck 53, and the deflection yoke 31 is mounted in the area between the funnel 55 and the neck 53, as shown in FIG. 6.

The outside diameter ϕDn of the neck 53 in the location where at least the deflection yoke 31 is mounted (by the clamping band 36 or the like), may preferably range from 23.6 mm to 25.0 mm in consideration of a manufacturing tolerance of ±0.7 mm. It is therefore preferable to set the minimum inside diameter ϕDi of the horizontal deflection coil 42 to a range of from 25 mm to 27 mm, increased by 0 mm to 2 mm from the maximum value of the outside diameter ϕDn of the neck 53 as shown in FIG. 7. Accordingly, the diameter ϕDi of the deflection coil 42 is formed to such a size that it encloses the circle 73 (see FIG. 7) of about 26 mm.

Thus, even when cathode ray tubes identical in size to each other are deflected, a horizontal deflection coil used in a conventional 29.1 mm-neck type color cathode-ray tube has an opening-side dimension of 37 mm and a length of 56 mm, measured from the neck end thereof to a tube-axial position (also reference line) at which an inner surface thereof is encloses a circle whose diameter is 56.5 mm. (See FIG. 9.) Thus, a dimension L1 (FIG. 6) of the horizontal deflection coil 42 of the deflection yoke 31 illustrated in the present embodiment ranges from not less than 20.5 mm to not more than 24.5 mm and the dimension of L2 (FIG. 6) thereof ranges from 46 mm to 50 mm, as compared with a deflection yoke whose overall tube-axial dimension can be as much as 93 mm. Therefore, the generated magnetic flux can be reduced to prevent an increase in the inductance, thereby improving the horizontal deflecting sensitivity.

Referring to FIG. 6, the deflection yoke 31 is configured so that a length L1 of the horizontal deflection coil 42 extending to the opening end 38, and a length L2 of the horizontal deflection coil 42 extending to the neck end 37, are set at about 22.5 mm and about 48 mm respectively, measured from the tube-axial position (along the reference line 71 of the deflection yoke 1) at which the inner surface of the deflection yoke 31 encloses a circle having the diameter ϕ of 56.5 mm. (See FIG. 6). Therefore, a fringe 42*a* (FIG. 7) of the opening side 38 of the horizontal deflection coil 42 is formed to such a size that it is enclosed by the circle 74 (FIG. 7) whose diameter ϕ Do is about 130 mm.

The outside diameter of the funnel 52 in the vicinity of the fringe 42*a* at the opening end 38 of the horizontal deflection coil 42 changes by about 2.5 mm in diameter for each change of 1 mm in the tube-axis direction. Therefore, the diameter ϕ Do is reduced in the deflection yoke 31 illustrated in the present embodiment, in which the length L1 (see FIG. 6) has been shortened. Thus, when the cathode ray tubes identical in size to one another are deflected, leakage flux generated in the fringe 42*a* at the opening end 38 of the horizontal deflection coil 42 can be reduced as compared with the deflection yoke for the conventional 29.1 mm-neck type color cathode-ray tube device. It is therefore possible to prevent an increase in the inductance of the horizontal deflection coil and thereby improve the horizontal deflecting sensitivity.

When the opening end 38 (extending from the deflection yoke 31 in the direction indicated by arrow X1, as seen from the reference line 71 in FIG. 6) of the horizontal deflection coil 42, vertical deflection coil 43 and core 44 is extended relative to the deflection yoke 31 (in which the dimension L1 from the reference line 71 is 22.5 mm and the dimension L2 is 48 mm), the horizontal deflecting sensitivity is desensitized by about 2% for each mm of such extension. Experiments have shown that maintaining changes of the horizontal deflecting sensitivity within 4% will assure a sufficient and satisfactory deflecting sensitivity. Thus, the length of further extension of the opening end 38 of the horizontal deflection coil 42 from the reference line 71 was set to 2 mm or less. When the opening end 38 of the horizontal deflection coil 42, vertical deflection coil 43 and core 44 is shortened relative to the deflection yoke 31 (in which L1 is 22.5 mm), the neck shadow tolerance is reduced by about 0.3 mm per 1 mm. Experiments have shown that the amount of change in the neck shadow tolerance may be set to 0.6 mm or less. Thus, the length to further shorten the opening side 38 of the horizontal deflection coil 42 from the reference line 71 was set to 2 mm or less.

Judging from the above description, the length L1 of the horizontal deflection coil 42 extending to the opening end 38 may preferably range from not less than 20.5 mm to not more than 24.5 mm.

Further, when the neck side 37 for the horizontal deflection coil 42, vertical deflection coil 43 and core 44 is extended (with L2=48 mm as the reference in the deflection yoke 31 shown in FIGS. 6 and 7), the neck shadow tolerance per 1 mm is shortened by about 0.6 mm. Experiments have thus confirmed that even when the opening end 38 is extended by the same length as the neck side 37, the length to be extended is preferably 2 mm or less, in order to maintain the neck shadow tolerance to a sufficient and satisfactory degree.

When the neck side 37 of the horizontal deflection coil 42, vertical deflection coil 43 and core 44 is shortened relative to a deflection yoke 31 of L2=48 mm, the horizontal deflecting sensitivity per 1 mm is desensitized or deteriorated by about 3%. Thus, since experiments have demonstrated that the desensitization of the horizontal deflecting sensitivity needs to reach 4% or less in a manner similar to the opening end 38 in order to maintain the horizontal deflecting sensitivity to a sufficient and satisfactory degree, it is preferable that the opening side 38 be shortened by 1 mm and the neck side 37 be shortened by 2 mm or less.

From the above description, the length L2 (FIG. 6) of the horizontal deflection coil 42 extending to the end of the neck side 37 may preferably be set to 46 mm to 50 mm.

The tube-axial length of the horizontal deflection coil 42 is equal to the sum of the lengths L1 and L2 shown in FIG. 6. It is thus preferable that the length of the horizontal deflection coil 42 ranges from 66.5 mm to 74.5 mm to maintain the horizontal deflecting sensitivity and the neck shadow tolerance sufficiently and satisfactorily.

It is also preferable that the size of the fringe 42*a* of the opening end 38 of the horizontal deflection coil 42 be such that it is enclosed in the surrounding circle 74 (FIG. 7) whose diameter ranges from 125 mm to 135 mm, based on the relationship between the range of the length L1 and the shape of the funnel 52 (see Fig. 8B) of the cathode ray tube 32.

In the color cathode ray tube 32 shown in FIG. 8B, an angle θ pp (extending in a diagonal direction of the fluorescent screen 51, in which the tube-axial position—the reference line 72 of the color cathode ray tube 32—at which the outside diameter of the funnel 52 becomes 56.5 mm is regarded as the origin) is set at about 100°. The angle θ pp corresponds to a deflection of 100° between a deflection of 90° and a deflection of 110°. Thus, the deflection angle of the cathode ray tube 32 may preferably be used as a range from 95° to 105°, if errors are taken into consideration.

In a color cathode-ray tube device of a type wherein a deflection yoke 31 is mounted to a color cathode ray tube 32 as shown in FIG. 9, the deflection yoke 31 is placed at a position retracted by about 3 mm from the point at which it contacts a funnel 52 of the color cathode ray tube 32. That is, a reference line 71 of the deflection yoke 31 (FIG. 6) is located on the neck end 37 removed by 3 mm with respect to a reference line 72 of the color cathode ray tube 32 (FIG. 9).

Thus, if dimensions L1 and L2=22.5 mm and 48 mm are respectively taken as examples, and the reference line 72 of the color cathode ray tube 32 is defined as the reference, the length L3 of the horizontal deflection coil 42 extending to the end of an opening end 38 reaches 19.5 mm, and the length L4 of the horizontal deflection coil 42 extending to the end of the electron gun 37 side becomes 51 mm. Accordingly, both the dimensions L3 and L4 and the tube-axial length of the color cathode ray tube 32 on the neck end 37 (as seen from the reference line 72 of the color cathode ray tube 32) can be made shorter than the conventional 29.1 mm-neck type color cathode-ray tube device.

Since the respective lengths L3 and L4 (see FIG. 9) of the horizontal deflection coil 42 are made shorter than the conventional 29.1 mm-neck type color cathode-ray tube device, and the effects of changes in the lengths L3 and L4 cancel each other, the problem of a neck shadow does not arise. If consideration is given to the length L1 of the horizontal deflection coil 42 (20.5 mm to 24.5 mm), the length L2 thereof (46 mm to 50 mm as shown in FIG. 6) and a mounting error of the deflection yoke 31 (+1 mm), then the length L3 of the horizontal deflection coil 42 is brought to a range of from 16.5 mm (20.5 mm−4 mm) to 22.5 mm (24.5 mm−2 mm), and the length L4 of the horizontal deflection coil 42 can be set to 48 mm (46 mm+2 mm) to 54 mm (50 mm+4 mm).

The display device shown in FIG. 9 has the video circuit 60, horizontal deflection circuit 61, vertical deflection circuit 62 and high-tension circuit 63, together with the color cathode-ray tube device provided with the deflection yoke 31. When the video signal is input to the terminal 85, the horizontal synchronizing signal is input to the terminal 86 and the vertical synchronizing signal is input to the terminal 87 respectively, the video circuit 60, horizontal deflection circuit 61, vertical deflection circuit 62 and high-tension circuit 63 are activated.

The horizontal deflection circuit 61 supplies a horizontal deflection current Ih to the horizontal deflection coil 42 to generate a horizontal deflection magnetic field. The vertical deflection circuit 62 supplies a vertical deflection current Iv to the main vertical deflection coil 43 and the auxiliary vertical deflection coil 47, to generate a vertical deflection magnetic field. The video signal is supplied to the video circuit 60 to control the electron gun 54. As a result, an electron beam modulated by the video signal is generated in the color cathode ray tube 32 and deflected by the horizontal and vertical deflection magnetic fields.

Thus, since the overall tube-axial length Lb (FIG. 9) of the color cathode ray tube 32 can be set to about 341 mm in the illustrated embodiment, the depth of the display device can be reduced as compared with the conventional display device. The aforementioned embodiment can be shortened in overall length as compared with the conventional 41 cm-100°-29.1 mm-neck type color cathode-ray tube device. The tube-axial length Lb of the color cathode ray tube 32 can be set to a range of 338 mm to 344 mm, including consideration of a manufacturing tolerance ±3 mm.

Figure 10:
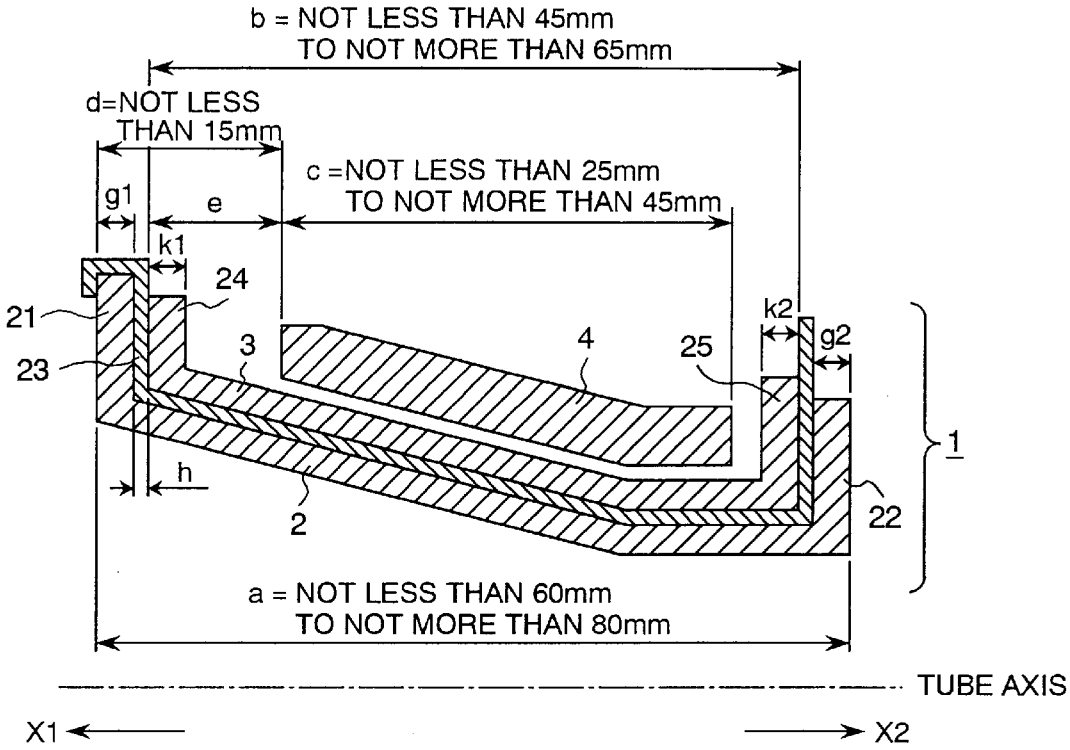
FIG. 10 is a fragmentary cross-sectional view depicting a modification of the deflection yoke according to the present invention.
Figure 11:
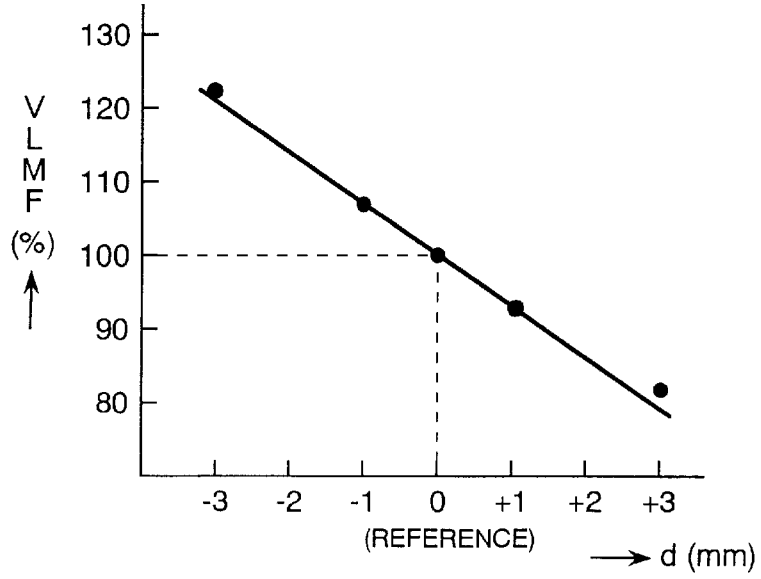
FIG. 11 is a VLMF characteristic diagram for describing another modification of the deflection yoke according to the present invention.

Deflection yokes capable of reducing undesired emissive magnetic fields will next be described with reference to FIGS. 10 through 13. FIG. 10 is a fragmentary cross-sectional view showing a modification of the deflection yoke according to the present invention. FIG. 11 is a VLMF (very low frequency magnetic field) characteristic diagram for describing the modification of the deflection yoke according to the present invention. The horizontal axis indicates a dimension d between the respective ends of a horizontal deflection coil and a core on the opening side, whereas the vertical axis indicates the percentage change in the very low frequency magnetic field VLMF.

In deflection yoke 1 shown in FIG. 10 according to the present invention, a dimension a of a horizontal deflection coil 2 ranges from 60 to 80 mm, a dimension b of a vertical deflection coil 3 ranges from 45 to 65 mm, and a dimension c of a core 4 ranges from 25–45 mm. The core 4 is mounted to the neck end so that a dimension d between the opening end of the core 4 and the opening end of the horizontal deflection coil 2, and a dimension e between the opening end of the core 4 and the opening end of the vertical deflection coil 3 are maximized. These increases in the dimensions d and e, reduce undesired emissive magnetic fields (VLMF, ELMF) generated from the deflection yoke 1, without having to use a cancel coil, as employed in the conventional example.

FIG. 11 is a characteristic diagram showing the percentage change of VLMF in response to variation of the opening end of the core and the opening end of the horizontal deflection coil. As is apparent from the drawing, the dimension d can be lengthened to reduce VLMF that is, VLMF can be reduced by shortening the opening end of the core 4 and lengthening the distance d.

The value of d to be used as the reference for satisfying a standardized or normalized value 25 nT or less of VLMF in FIG. 11 has been determined experimentally. When the dimension a of the horizontal deflection coil 2 is set to 70 mm, the dimension b of the vertical deflection coil 3 is set to 55 mm and the dimension c of the core 4 is set to 35 mm, several pieces of data for satisfying this normalized value at the dimension d=22 mm can be obtained. In order to satisfy the normalized value of VLMF stably, the dimension d must be 25 mm or more. It is understood that when the horizontal deflection coil 2 is extended in the neck direction, the necessary dimension d is reduced, and may be 15 mm or more.

At the same time, it should be noted that the maximum value of the dimension d is determined by physical limits or requirements for the horizontal deflection coil 2, vertical deflection coil 3, core 4 and separator 23 of the deflection yoke. For example, the maximum value of d reaches that which is obtained by subtracting the maximum length of the core 4 (25 mm), the thickness g2 of a fringe 22 of the horizontal deflection coil 2 (about 6.3 mm), the thickness of the separator 23 (about 1.2 mm), the thickness k2 of a fringe 25 of the vertical deflection coil 3 (about 6.3 mm), and the dimension of a space between a neck end fringe 24 of the vertical deflection coil 3 and the neck end of the core 4 (about 1 mm), from the maximum value (80 mm) of the dimension a of the horizontal deflection coil 2. In this case, the maximum value of the dimension d therefore becomes 40.2 mm, i.e., about 40 mm.

In the present invention as has been described above, VLMF generated from the deflection yoke 1 can be reduced without having to use the cancel coil which is employed in the conventional example. Thus, the deflection yoke can be reduced in size and cost with no degradation in horizontal deflecting sensitivity.

Figure 12:
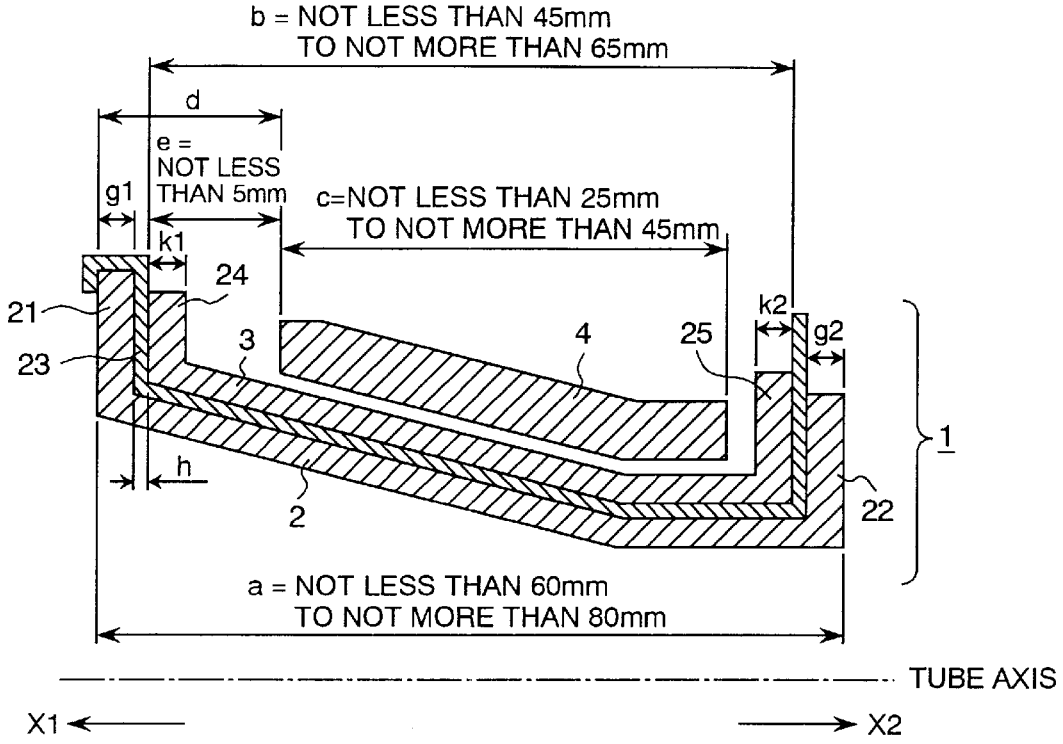
FIG. 12 is a fragmentary cross-sectional view showing a further modification of the deflection yoke according to the present invention.
Figure 13:
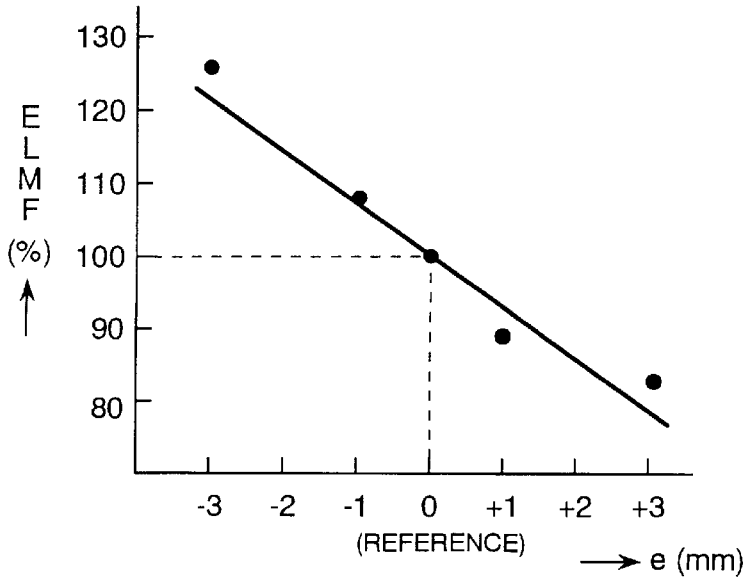
FIG. 13 is an ELMF characteristic diagram for describing a still further modification of the deflection yoke according to the present invention.

FIG. 12 is a fragmentary cross-sectional view showing a further modification of the deflection yoke according to the present invention. FIG. 13 is a characteristic diagram for describing a still further modification of the deflection yoke according to the present invention. The horizontal axis in FIG. 13 indicates a dimension e between the opening end of a vertical deflection coil and the opening end of a core, whereas the vertical axis indicates the percentage change in extremely low frequency magnetic field (ELMF).

Experiments have been performed to evaluate the relationship between the dimension e (between the end of a core 4 and a vertical deflection coil 3) and ELMF in a deflection yoke 1 wherein dimension a of a horizontal deflection coil 2 ranges from 60 to 80 mm, dimension b of the vertical deflection coil 3 ranges from 45 to 65 mm and the dimension c of the core 4 ranges from mm to 45 mm. FIG. 13 shows the result of these experiments.

The drawing shows the percentage change in ELMF in response to variation of the dimension e between the opening end of the core 4 and the opening end of the vertical deflection coil 3. It can be understood from the drawing that the dimension e may be lengthened to reduce ELMF. That is, if the opening end of the core 4 is shortened to increase the dimension e, then ELMF can be reduced.

Next, the value of e to be used as the reference for satisfying a normalized value 200 nT or less, has been determined by experiment. When the dimension a of the horizontal deflection coil 2 is 70 mm, the dimension b of the vertical deflection coil 3 is 55 mm and the dimension c of the core 4 is 35 mm, the normalized value of ELMF could be satisfied stably at the dimension e=15 mm. It is understood that when the horizontal deflection coil 2 is extended toward the neck end, the necessary dimension e is reduced, and may be 5 mm or more. In this regard, it should be noted that the maximum value of the dimension e is restricted by the physical configuration of the deflection yoke in a manner similar to the dimension d. The dimension e can be determined by subtracting the thickness g1 of a fringe of the horizontal deflection coil 2 and the thickness of a separator 23, from the dimension d. For example, the maximum value of the dimension e reaches a value obtained by subtracting the fringe thickness g1 (about 6.3 mm) and the thickness of the separator 23 (1.2 mm) from the maximum dimension of d (40 mm). In this case, the dimension e results in 32.5 mm, i.e., about 33 mm.

In the present invention as has been described above, ELMF generated from the deflection yoke 1 can be reduced without having to use the cancel coil employed in the conventional prior art devices. In the present invention, no degradation occurs in vertical deflecting sensitivity, and the deflection yoke can be reduced in size and cost.

Figure 14:
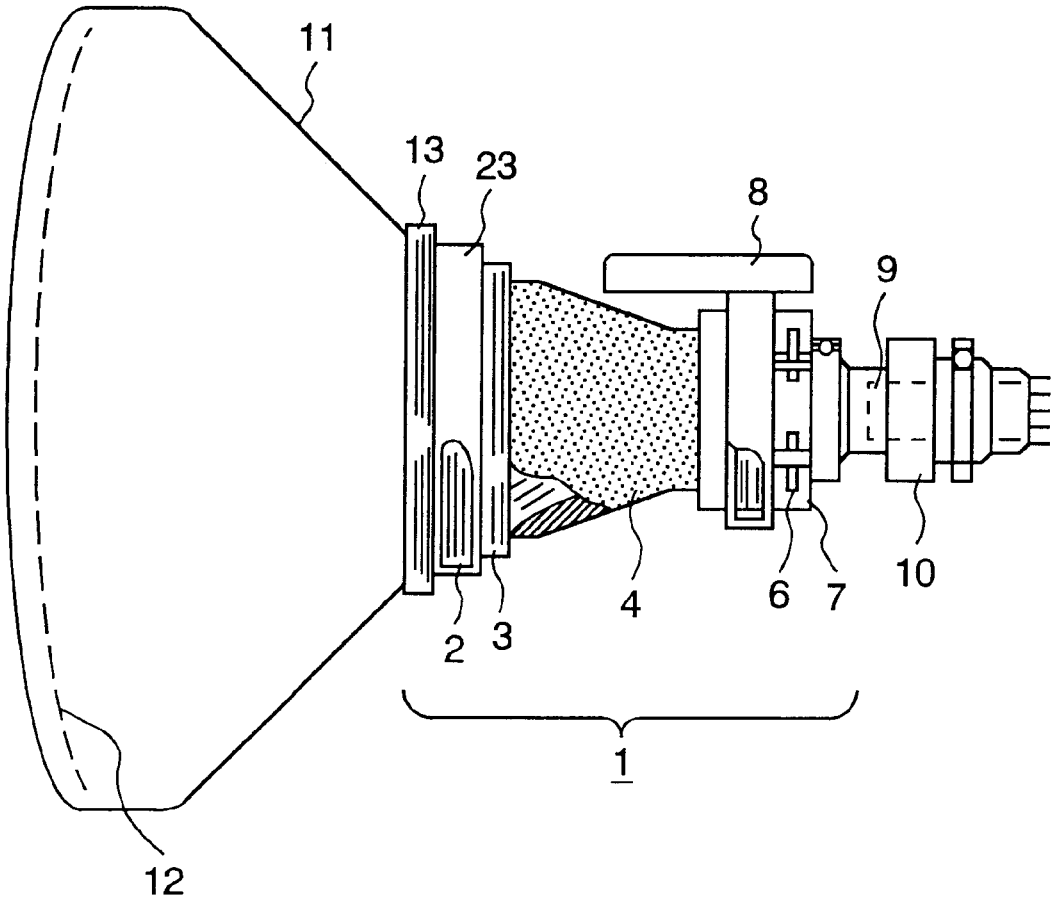
FIG. 14 is a side view showing one embodiment of a cathode ray tube provided with a deflection yoke according to the present invention.

FIG. 14 is a side view showing one embodiment of a cathode-ray tube provided with a deflection yoke according to the present invention. In the drawing, reference numeral 23 indicates a separator, while 6 is a magnetic substance or material for a vertical auxiliary coil, 7 is the vertical auxiliary coil, 8 a terminal cover, 9 an electron gun, 10 a static convergence magnet, 11 a cathode ray tube body, 12 a fluorescent screen, and 13 an image rotating coil. The parts which correspond to those shown in FIG. 1 are identified by the same reference numerals.

In the drawing, a deflection yoke 1 is mounted on the neck of a cathode ray tube 11 provided with the fluorescent screen 12 at its frontal surface. Further, the electron gun 9 is attached to the neck of the cathode ray tube 11. The deflection yoke 1 is constructed so that a core 4 comprised of a magnetic material is placed on the outer peripheries of a horizontal deflection coil 2 and a vertical deflection coil 3. The magnetic material 6 on which the vertical deflection coil 7 is wound, is provided on the electron gun 9 side, and the image rotating coil 13, wound in ring form to correct rotational components of an image, is placed on the fluorescent screen 12 side.

This type of cathode-ray tube device utilizes previously-described deflection yoke 1, whereby it can satisfy the normalized values for the undesired emissive magnetic fields (VLMF, ELMF).

Figure 15:
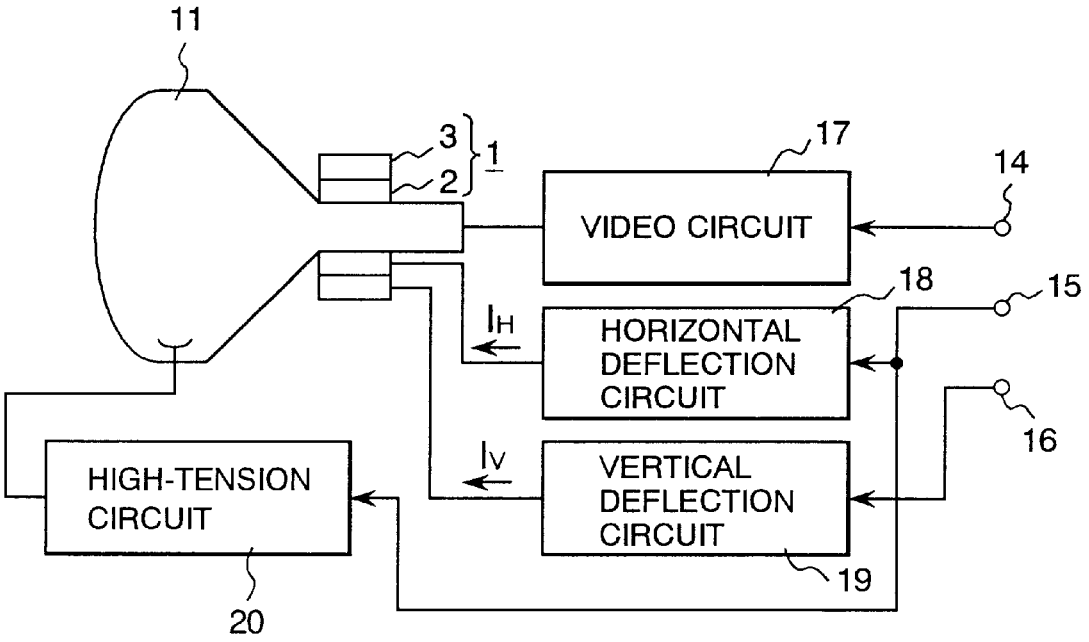
FIG. 15 is a block diagram illustrating one embodiment of a display device provided with a deflection yoke according to the present invention.

FIG. 15 is a configurational diagram showing one embodiment of a display device provided with a deflection yoke according to the present invention. Reference numeral 14 indicates a terminal for inputting a video signal, while reference number 15 is a terminal for inputting a horizontal synchronizing signal, 16 a terminal for inputting a vertical synchronizing signal, 17 a video circuit, 18 a horizontal deflection circuit, 19 a vertical deflection circuit, and 20 is a high-tension circuit. Parts corresponding to those shown in FIG. 14 are identified by the same reference numerals.

In the embodiment illustrated in the drawing, the cathode-ray tube device shown in FIG. 14 is provided with the video circuit 17, horizontal deflection circuit 18, vertical deflection circuit 19, high-tension circuit 20, etc. The video signal is received at the input terminal 14, electrically processed by the video circuit 17, and supplied to the cathode-ray tube device. The horizontal synchronizing signal is received at the input terminal 15 and thereafter supplied to the horizontal deflection circuit 18, where a horizontal deflection current IH is formed and supplied to a horizontal deflection coil 2 of the deflection yoke 1. Further, the horizontal synchronizing signal is also supplied to the high-tension circuit 20 where an electrical potential is produced and supplied to the cathode-ray tube device. The vertical synchronizing signal is received at the input terminal 16, and thereafter supplied to the vertical deflection circuit 19 where a vertical deflection current IV is formed and supplied to a vertical deflection coil 3 of the deflection yoke 1. The cathode-ray tube device is driven in this way.

The present display device utilizes the previously-described deflection yoke 1 in this way, and hence can satisfy the normalized values for the undesired emissive magnetic fields (VLMF, ELMF).

According to the present invention as has been described above, a deflection yoke suitable for attachment to a color cathode ray tube having a neck whose diameter ranges from 22 mm to 26 mm and providing deflections ranging from 95° to 110° can be provided.

Further, a deflection yoke according to the present invention can be applied to a cathode ray tube having a tube axis shorter than a tube-axial length or dimension of the conventional color cathode ray tube. Further, the inductance of a horizontal deflection coil can be prevented from increasing and the horizontal deflecting sensitivity is satisfactory.

The invention may be embodied in other specific forms without departing from the spirit or essential characteristics thereof. The present embodiment is therefore to be considered in all aspects as illustrative and not restrictive, the scope of the invention being indicated by the appended claims rather than by the foregoing description and all changes which come within the meaning and range of equivalency of the claims are therefore intended to be embraced therein.

What is claimed is:

1. A deflection yoke for a cathode ray tube wherein the diameter of a neck thereof ranges from 22 mm to 26 mm and a deflection angle thereof ranges from 95° to 110°, comprising:

a horizontal deflection coil whose dimension relative to an axial direction of said cathode ray tube in an installed position of said yoke, ranges from not less than 60 mm to not more than 80 mm;

a vertical deflection coil whose dimension relative to said axial direction ranges from 45 mm to 65 mm; and a core whose dimension relative to said axial direction ranges from 25 mm to 45 mm.

2. The deflection yoke according to claim 1, wherein:

said horizontal deflection coil has fringe portions respectively provided at an opening end thereof and a neck end; and said vertical deflection coil has fringe portions respectively provided at an opening end thereof and the neck end.

3. The deflection yoke according to claim 1, wherein said vertical deflection coil is placed on an outer periphery of said horizontal deflection coil, and a separator is provided between said vertical deflection coil and said horizontal deflection coil.

4. The deflection yoke according to claim 3, wherein the distance between an opening end of said horizontal deflection coil and the opening end of said core ranges from 15 mm to 40 mm.

5. The deflection yoke according to claim 1, wherein the distance between the opening end of said horizontal deflection coil and an opening end of said core is at least 15 mm.

6. The deflection yoke according to claim 1, wherein the distance between an opening end of said vertical deflection coil and an opening end of said core is at least 5 mm.

7. The deflection yoke according to claim 6, wherein the distance between the opening end of said vertical deflection coil and the opening end of said core ranges from 5 mm to 33 mm.

8. A cathode-ray tube device comprising:

a cathode ray tube wherein the diameter of a neck thereof ranges from 22 mm to 26 mm and a deflection angle thereof ranges from 95° to 110°; and a deflection yoke mounted on the neck of the cathode ray tube, said deflection yoke including a horizontal deflection coil whose dimension in an axial direction of said cathode ray tube ranges from 60 mm to 80 mm; and a vertical deflection coil whose dimension in said axial direction ranges from 45 mm to 65 mm; and a core whose dimension in said axial direction ranges from 25 mm to 45 mm.

9. The cathode-ray tube device according to claim 8, wherein said deflection yoke is constructed so that the distance between an opening end of said horizontal deflection coil and an opening end of said core is at least 15 mm.

10. The cathode-ray tube device according to claim 8, wherein said deflection yoke is constructed so that the distance between an opening end of said vertical deflection coil and an opening end of said core is at least 5 mm.

11. A display device comprising:

a cathode ray tube wherein the diameter of a neck thereof ranges from 22 mm to 26 mm and a deflection angle thereof ranges from 95° to 110°;

a deflection yoke mounted on the neck of said cathode ray tube, said deflection yoke including a horizontal deflection coil whose dimension in an axial direction of said cathode ray tube ranges from 60 mm to 80 mm;

a vertical deflection coil whose dimension in said axial direction ranges from 45 mm to 65 mm; and a core whose dimension in said axial direction ranges from 25 mm to 45 mm;

a video circuit electrically connected to said cathode ray tube;

a horizontal deflection circuit electrically connected to said horizontal deflection coil; and a vertical deflection circuit electrically connected to said vertical deflection coil.

12. The display device according to claim 11, wherein said deflection yoke is configured so that a distance between an opening end of said horizontal deflection coil and an opening end of said core is at least 15 mm.

13. The display device according to claim 11, wherein said deflection yoke is configured so that a distance between an opening end of said vertical deflection coil and opening end of said core is at least 5 mm.

14. A deflection yoke for a 95° to 105° deflection type color cathode ray tube having a fluorescent screen whose diagonal dimension ranges from 400 mm to 420 mm and a neck whose outside diameter ranges from 23.6 mm to 25.0 mm at a portion where said deflection yoke is attached thereto, comprising:

a horizontal deflection coil;

a vertical deflection coil placed outside said horizontal deflection coil; and a core disposed outside said vertical deflection coil; wherein in an installed position of said yoke in a tube axial position, an inner surface of said deflection yoke is circumscribed around a circle having a diameter of 56.5 mm; and said horizontal deflection coil is configured so that a length thereof extending from said tube axial position to an opening end of said horizontal deflection coil ranges from 20.5 mm to 24.5 mm and a length thereof extending from said tube axial position to a neck end of said horizontal deflection coil ranges from 46 mm to 50 mm.

15. A deflection yoke adapted to be mounted within a range of a funnel of a color cathode ray tube to a neck thereof, said color cathode ray tube having a fluorescent screen whose diagonal dimension ranges from 400-mm to 420 mm, the funnel suited to deflections of 95° to 105°, the neck whose outside diameter ranges from 23.6 mm to 25.0 mm, and an electron gun provided within said neck and for generating inline-arranged multiple electron beams, said deflection yoke comprising:

a horizontal deflection coil;

a vertical deflection coil placed outside said horizontal deflection coil; and a core placed outside said vertical deflection coil; wherein a minimum inside diameter of said horizontal deflection coil ranges from 25 mm to 27 mm;

a tube-axial length of said horizontal deflection coil ranges from 66.5 mm to 74.5 mm; and a fringe of said horizontal deflection coil on its opening end is circumscribed by a circle whose diameter ranges from 125 mm to 135 mm.

16. A color cathode-ray tube device comprising:

a color cathode ray tube having a fluorescent screen whose diagonal dimension ranges from 400 mm to 420 mm, a funnel deflections of 95° to 105°, a neck whose outside diameter ranges from 23.6 mm to 25.0 mm, and an electron gun provided within said neck, for generating inline-arranged multiple electron beams; and a deflection yoke mounted in an area between said funnel of said cathode ray tube and said neck thereof, and having a horizontal deflection coil and a vertical deflection coil; wherein an opening end of said horizontal deflection coil is positioned within a range of 16.5 mm to 22.5 mm from a tube axial reference position at which an outside diameter of said funnel is 56.5 mm; and a position of a neck end of said horizontal deflection coil is disposed within a range of 48 mm to 54 mm from said tube axial reference position.

17. A display device comprising:

a color cathode ray tube having a fluorescent screen whose diagonal dimension ranges from 400 mm to 420 mm, a funnel for deflections of 95° to 105°, a neck whose outside diameter ranges from 23.6 mm to 25.0 mm, and an electron gun provided within said neck and for generating inline-arranged multiple electron beams, said color cathode ray tube having a tube axial length which ranges from 338 mm to 344 mm;

a deflection yoke mounted in an area between said funnel of said cathode ray tube and said neck thereof, and having a horizontal deflection coil and a vertical deflection coil;

a video circuit for controlling a beam of electrons produced from said electron gun;

a horizontal deflection circuit for supplying a horizontal deflection current to said horizontal deflection coil;

a vertical deflection circuit for supplying a vertical deflection current to said vertical deflection coil; and a high-tension circuit for supplying a high voltage to said color cathode ray tube; wherein an opening end of said horizontal deflection coil is positioned within a range of from 16.5 mm to 22.5 mm from a tube-axial reference position where the outside diameter of said funnel is 56.5 mm;

a position of a neck end of said horizontal deflection coil is positioned within a range of from 48 mm to 54 mm from the tube axial reference position.

* * * * *